US008985534B1

(12) United States Patent
Hazzard et al.

(10) Patent No.: US 8,985,534 B1
(45) Date of Patent: Mar. 24, 2015

(54) MULTI-CONFIGURABLE TV STAND WITH BRIDGING MOUNT STRUCTURE

(71) Applicant: Whalen Furniture Manufacturing Inc., San Diego, CA (US)

(72) Inventors: Thomas Barr Hazzard, Ladera Ranch, CA (US); Tracy Leigh Hazzard, Ladera Ranch, CA (US)

(73) Assignee: LF Centennial Limited, Road Town Tortola (VG)

( * ) Notice: Subject to any disclaimer, the term of this patent is extended or adjusted under 35 U.S.C. 154(b) by 84 days.

(21) Appl. No.: 13/934,366

(22) Filed: Jul. 3, 2013

Related U.S. Application Data

(60) Provisional application No. 61/680,713, filed on Aug. 8, 2012.

(51) Int. Cl.
*A47B 81/06* (2006.01)
*F16M 11/22* (2006.01)

(52) U.S. Cl.
CPC ..... *A47B 81/06* (2013.01); *F16M 11/22* (2013.01); *Y10S 248/923* (2013.01)
USPC ..... 248/176.1; 248/923

(58) Field of Classification Search
CPC ..... A47B 81/06; F13M 11/22
See application file for complete search history.

(56) References Cited

U.S. PATENT DOCUMENTS

| | | | |
|---|---|---|---|
| 366,525 | A | 7/1887 | Taliaferro |
| 368,388 | A | 8/1887 | Drake |
| 866,522 | A | 9/1907 | Scanlon |
| 1,324,537 | A | 12/1919 | Belcher |
| 1,398,601 | A | 11/1921 | Osterhout |
| 1,590,726 | A | 6/1926 | Corsgren |
| 1,598,569 | A | 8/1926 | Fitzhugh |
| 1,692,337 | A | 11/1928 | Forbes |
| 1,797,847 | A | 3/1931 | Vandagriff |
| 2,193,647 | A | 3/1940 | Rush |
| 2,359,895 | A | 10/1944 | Burton |
| D141,593 | S | 6/1945 | Doty |
| 2,535,112 | A | 12/1950 | Woody |
| 2,605,155 | A | 7/1952 | Lewis |
| 3,232,249 | A | 2/1966 | Perez |
| 3,358,957 | A | 12/1967 | Lindenmuth |
| 3,875,356 | A | 4/1975 | Heim |
| 3,905,573 | A | 9/1975 | Davis |

(Continued)

FOREIGN PATENT DOCUMENTS

| | | |
|---|---|---|
| JP | 2006060754 | 3/2006 |
| WO | 2009143771 | 3/2009 |

*Primary Examiner* — Amy Sterling
(74) *Attorney, Agent, or Firm* — Barlow, Josephs & Holmes, Ltd.

(57) ABSTRACT

A flat panel television console and support kit allows the consumer to employ any of three modes of support, namely stand mount, console mount, and wall mount. The console assembly has upper and lower shelves on upper and lower shelf supports, which are supported between a pair of legs. A bridge receptacle is located on the upper end of each leg. A bridging structure has ends that can be received in the bridge receptacles. A vertical column having a lower end is detachably secured to the bridging structure at a joint so that the vertical column extends upwardly from the bridging structure, providing an elevated support for a flat panel television. A cap structure can be received in the bridge receptacles when the bridging structure is not used, and a flat panel television may be mounted on a stand on the console or on a wall mount.

16 Claims, 5 Drawing Sheets

(56) References Cited

U.S. PATENT DOCUMENTS

| | | | |
|---|---|---|---|
| 4,020,510 | A | 5/1977 | Fabian |
| 4,076,203 | A | 2/1978 | McDonnell |
| 4,272,136 | A | 6/1981 | Sengua |
| 4,410,158 | A | 10/1983 | Maffei |
| 4,444,323 | A | 4/1984 | Travis |
| 4,993,676 | A | 2/1991 | Fitts |
| 5,139,223 | A | 8/1992 | Sedighzadeh |
| 5,207,405 | A | 5/1993 | Cobb |
| 5,282,427 | A | 2/1994 | Steinhilber |
| 5,549,264 | A | 8/1996 | West |
| 6,158,701 | A | 12/2000 | Deshler |
| 6,288,891 | B1 | 9/2001 | Hasegawa |
| 6,327,982 | B1 | 12/2001 | Jackson |
| 6,347,433 | B1 | 2/2002 | Novin |
| D454,731 | S | 3/2002 | Niitsu |
| D458,053 | S | 6/2002 | Luong |
| 6,425,631 | B1 | 7/2002 | Lin |
| 6,609,691 | B2 | 8/2003 | Oddsen |
| D480,237 | S | 10/2003 | deCarolis |
| 6,672,465 | B2 | 1/2004 | White |
| 6,695,270 | B1 | 2/2004 | Smed |
| 6,699,146 | B1 | 3/2004 | Winter |
| 6,704,193 | B2 | 3/2004 | Vathulya |
| 6,758,454 | B2 | 7/2004 | Smed |
| D495,163 | S | 8/2004 | Weatherly |
| 6,796,536 | B1 | 9/2004 | Sevier |
| 6,905,101 | B1 | 6/2005 | Dittmer |
| D507,900 | S | 8/2005 | Sexton, III |
| D508,801 | S | 8/2005 | Holst |
| 6,923,413 | B2 | 8/2005 | Dozier |
| D517,349 | S | 3/2006 | Lara |
| D524,080 | S | 7/2006 | Stenhouse |
| 7,082,882 | B2 | 8/2006 | Heimbrock |
| 7,118,080 | B2 | 10/2006 | Chan |
| D531,428 | S | 11/2006 | Choo |
| 7,175,146 | B2 | 2/2007 | Kim |
| 7,178,775 | B2 | 2/2007 | Pfister |
| D537,658 | S | 3/2007 | Tung |
| D539,125 | S | 3/2007 | Ly Hau |
| 7,195,213 | B2 | 3/2007 | Weatherly |
| D539,565 | S | 4/2007 | Sexton, III |
| D541,138 | S | 4/2007 | Whalen |
| 7,261,261 | B2 | 8/2007 | Ligertwood |
| D564,261 | S | 3/2008 | Sculler |
| D565,054 | S | 3/2008 | Anderson |
| D566,426 | S | 4/2008 | Stenhouse |
| D567,546 | S | 4/2008 | Liu |
| D570,620 | S | 6/2008 | Ongor |
| D574,698 | S | 8/2008 | Grey |
| 7,530,538 | B2 | 5/2009 | Whalen |
| D595,978 | S | 7/2009 | Portnoy |
| D604,962 | S | 12/2009 | Daud |
| D607,671 | S | 1/2010 | Sexton, III |
| 8,191,485 | B1 * | 6/2012 | Whalen et al. ..... 108/42 |
| 2002/0011544 | A1 | 1/2002 | Bosson |
| 2004/0011932 | A1 | 1/2004 | Duff |
| 2004/0031897 | A1 | 2/2004 | Holland |
| 2004/0041062 | A1 | 3/2004 | Ozolins |
| 2004/0079849 | A1 | 4/2004 | Rudolf |
| 2004/0079858 | A1 | 4/2004 | Rudolf |
| 2004/0084578 | A1 | 5/2004 | Cho |
| 2004/0084579 | A1 | 5/2004 | Lee |
| 2004/0113031 | A1 | 6/2004 | Sung |
| 2004/0118984 | A1 | 6/2004 | Kim |
| 2004/0188573 | A1 | 9/2004 | Weatherly |
| 2004/0188574 | A1 | 9/2004 | Weatherly |
| 2004/0211870 | A1 | 10/2004 | Bremmon |
| 2004/0256524 | A1 | 12/2004 | Beck |
| 2005/0041379 | A1 | 2/2005 | Jang |
| 2005/0045782 | A1 | 3/2005 | Lee |
| 2005/0167549 | A1 | 8/2005 | Ligertwood |
| 2005/0236530 | A1 | 10/2005 | Weatherly |
| 2007/0246629 | A1 | 10/2007 | Saxton |
| 2007/0252919 | A1 | 11/2007 | McGreevy |
| 2008/0156949 | A1 | 7/2008 | Sculler |
| 2009/0039212 | A1 | 2/2009 | Whalen |
| 2011/0043978 | A1 | 2/2011 | Bremmon |
| 2011/0079688 | A1 | 4/2011 | Grove |

* cited by examiner

MULTI-CONFIGURABLE TV STAND WITH BRIDGING MOUNT STRUCTURE

CROSS REFERENCE TO RELATED APPLICATION

This application is related to and claims priority to earlier filed U.S. provisional patent application 61/680,713, filed Aug. 8, 2012, the entire contents of which is incorporated herein by reference.

BACKGROUND AND SUMMARY OF THE INVENTION

The instant invention relates to the field of mounting systems for televisions to be wall-mounted or carried on a base (console).

The instant invention provides a flat panel television console and support kit for supporting a flat panel television (sold separately) in a plurality of different user assembled configurations. The kit incorporates components for a flat panel television console assembly with multiple shelves carried on horizontally extending shelf supports.

The manufacturer delivers to the consumer an unassembled kit including assembly instructions that instruct the consumer to assemble the console by engaging the shelves with the shelf supports and connecting the shelf supports to a pair of legs for structural support. When the shelves and legs are assembled, a flat panel television can be supported on an upper surface of the upper shelf.

The kit is customizable to suit consumer preferences. The kit includes additional features that may be selectively arranged and connected, depending on the desired configuration. The kit includes a bridging structure having two ends that can each be received in a bridge receptacle at an upper end of the first and second legs. The kit also includes a vertical column that has a lower end that can be detachably secured at a joint on the bridging structure so that the vertical column extends upwardly from the bridging structure. As described herein, the bridging structure and vertical column can be used together to provide an elevated support for the flat panel television. The kit also includes first and second cap structures that can be selectively received in the bridge receptacles when the bridging structure is not in use. For mounting a flat panel television, the kit includes a flat panel television mounting frame.

To facilitate customization of the console assembly by the consumer, the kit includes assembly instructions for various embodiments. Assembly instructions direct a consumer to assemble the kit in a first configuration in which a flat panel television is secured to the mounting frame, the mounting frame is secured adjacent to an upper end of the vertical column. The vertical column is hollow and has at least one opening for receiving wires, so that wires from the TV may be hidden within the vertical column. The vertical column is secured to the bridging structure, and the ends of the bridging structure are detachably secured in the bridge receptacles in the legs of the console assembly. The bridge receptacles may be upwardly facing openings, which may receive projections on the ends of the bridging structure. The consumer may then fasten the bridging structure to the legs. In this configuration, the flat panel television is supported above the upper surface of the upper shelf by the vertical column.

The kit may include a sound bar or sensor shelf that is detachably secured to the vertical column and extends horizontally from the vertical column. The sound bar/sensor shelf may be secured to the vertical column at various vertical positions.

The joint at which the vertical column is secured to the bridging structure may be fixed or may allow the vertical column to rotate with respect to the bridging section.

The bridging section may be in the form of an arch or may be linear between its ends.

The assembly instructions further directs a consumer to assemble the kit in a second possible configuration in which the flat panel television is secured to the mounting frame and the mounting frame is secured to a wall. Caps are received in the bridge receptacles in the legs. The console is positioned beneath the flat panel television, and can be used to support accessory components for the flat panel television.

Additionally, the assembly instructions directs a consumer to assemble the kit in a third possible configuration in which the consumer places a flat panel television, inclusive of its own stand (or base), on the upper shelf of the console. In this configuration, the consumer inserts the caps in the bridge receptacles on the legs.

Accordingly, among the objects of the instant invention is the provision of a console assembly, a bridging structure, a vertical column, a cap structure and a mounting frame that can be constructed and arranged with an aesthetically matched design to form an aesthetically matched set of kit components. It is further an object of the present invention to provide advantages for the consumer and the retailer. For the retailer, stocking the kit avoids having to stock multiple disparate kits, which would create a customer service burden, to help the consumer select the right kit, and restocking costs when kits are returned. For the consumer, the kit satisfies the mounting requirements for virtually any TV that the consumer might initially use it with, and to TVs that the consumer may acquire in the future. The console may be assembled and used alone with a conventional CRT TV, or with a flat panel TV mounted on its own stand (base). Then later when the consumer acquires a Vesa standard LCD TV, for example, the consumer can attach the mounting frame to the bridging structure, attach the bridging structure to the legs, and suspend the flat panel TV above the console by securing the flat panel TV to the mounting frame. Should the consumer later acquire a still larger TV, or prefer wall mounting, the mounting frame can be used again, and secured to a wall. The kit incorporates multipurposed components to reduce the parts count. All components can be broken down to lie flat for shipping and storage in the minimum space. The kit provides for a floating appearance of the flat panel TV above the console and this visual effect is enhanced by being able to hide the wires and cables within the support.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated of carrying out the present invention.

DESCRIPTION OF THE PREFERRED EMBODIMENT

Figure 1A:
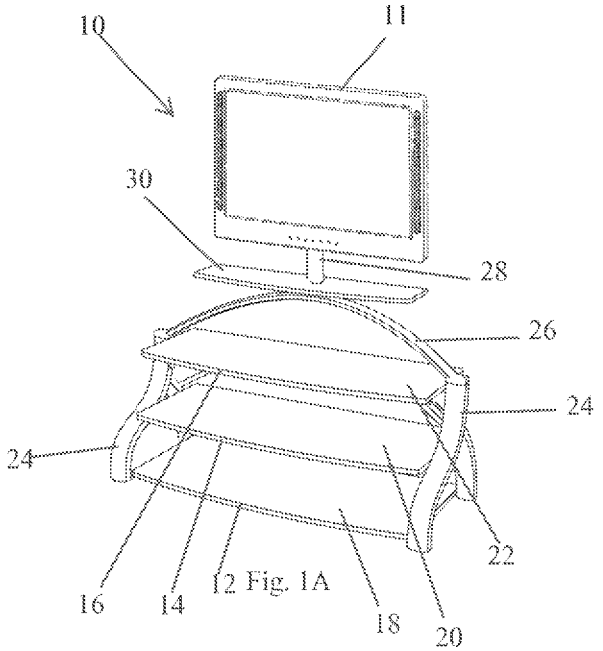
FIG. 1A is a perspective view of the flat panel television console and support kit of the present invention in a first configuration.

Referring now to the drawings, the flat panel television (TV) console and support kit of the instant invention is illustrated and generally indicated at 10 in FIGS. 1A-16. As will hereinafter be more fully described, the instant invention provides a multi-configurable television stand with a bridging structure and bridging mount structure that is usable in various configurations as selected by the consumer.

The manufacturer provides a set of aesthetically matched kit components that can be assembled in an aesthetically matched design in at least three configurations. FIGS. 1A, 1B, 2, and 3 show various configurations from which a consumer can choose when assembling the flat panel television console and support kit provided by the manufacturer. FIG. 1C shows a printed set of assembly instructions 15 that instruct the user to assemble the kit in the various configurations. In each configuration, the television 11 is mounted in a viewable position either on or above the console 10, which can be used to support TV accessories (not shown—sold separately). Consumers can select from these configurations according to their preferences and the physical dimensions of the space in which they place the assembled console. The kit includes all of the parts required for the various configurations, and a consumer may convert the console from one configuration to another by incorporating or removing kit components, according to the assembly instructions, as discussed below.

Each of the configurations in FIGS. 1A, 1B, 2, and 3 includes a console 10 for supporting accessory components and a flat panel television 11 (sold separately), depending on the configuration. The console assembly 10 includes lower, middle, and upper horizontally extending shelf supports 12, 14, 16 supported between a pair of legs, 24. Lower, middle, and upper shelves 18, 20, 22 are supported on the lower, middle, and upper shelf supports, 12, 14, 16, respectively. The console 10 can support a flat panel television 11 on the upper surface of the upper shelf 22. The console 10 may include more or fewer legs or shelf supports and shelves without departing from the scope of the present invention.

The kit also includes a television mounting frame 34 to which a flat panel television 11 may be secured. The mounting frame 34 may be secured to the wall or to the console assembly 10, depending on the desired configuration of the kit components, as discussed in more detail below.

The consumer may detachably secure a sound bar/sensor shelf 30 to the vertical column 28 at various positions. In FIG. 1A, the consumer has chosen to place the sound bar/sensor shelf 30 of the kit below the TV 11, while in FIG. 1B, the consumer has chosen to place the sound bar/sensor shelf 30 above the TV 11.

Figure 1B:
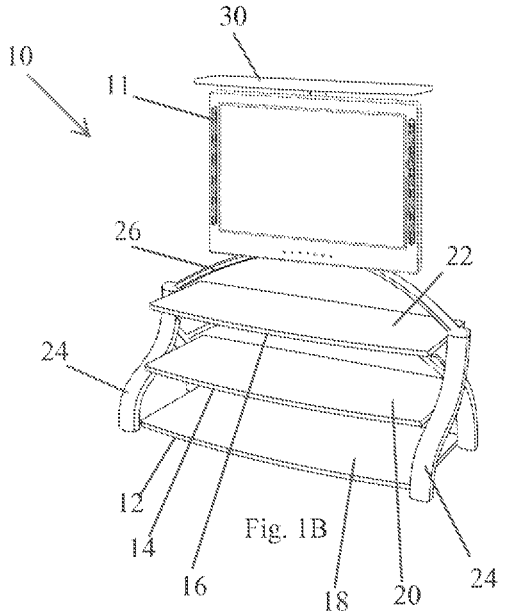
FIG. 1B is a perspective view thereof in a first configuration with the sound bar/sensor shelf positioned above the mounting frame.
Figure 1C:
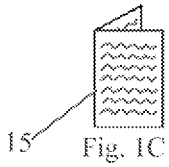
FIG. 1C is a perspective view of assembly instructions.

The assembly instructions 15 direct a consumer to assemble the kit in a first configuration, shown in FIGS. 1A and 1B. In this configuration, a flat panel television 11 is secured to the mounting frame 34, and the mounting frame 34 is secured towards the upper end of the vertical column 28, which is secured to the bridging structure 26 at a joint. The consumer attaches the bridging structure 26 to the console 10 by inserting each end of the bridging structure 26 into a bridge receptacle 25 in the legs 24 of the console 10. In this configuration, the legs 24, bridging structure 26, vertical column 28, and mounting frame 34 provide a secure support structure for the flat panel TV 11 so that the TV 11 is supported above the console 10.

The vertical column 28 is hollow and has at least one opening for receiving wires. Thus, the consumer can hide wires connected to the TV 11 by running them through the vertical column 28.

Figure 2:
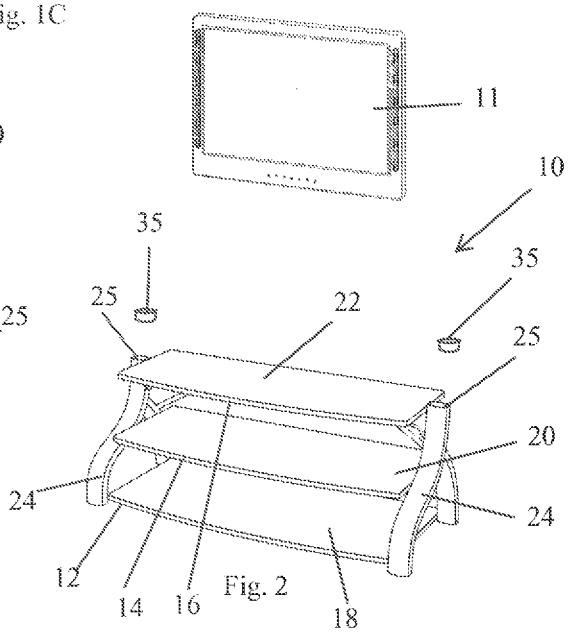
FIG. 2 is a perspective view of the kit in a second configuration.
Figure 5:
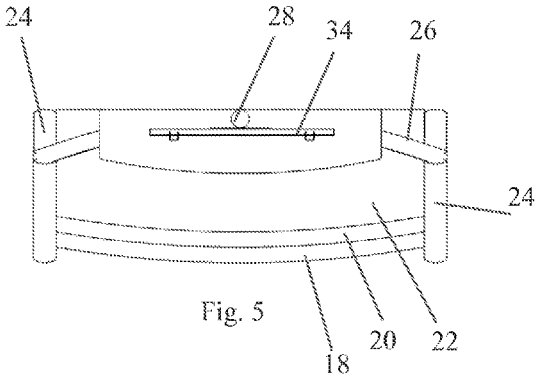
FIG. 5 is a top view thereof.
Figure 4:
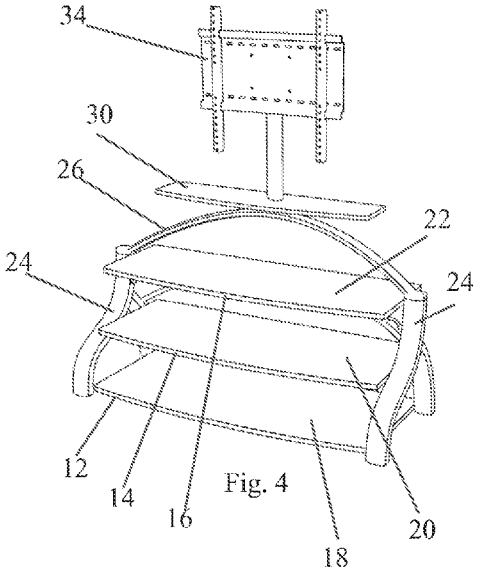
FIG. 4 is a perspective view of the kit in a first configuration without a television mounted on the mounting frame.
Figure 6:
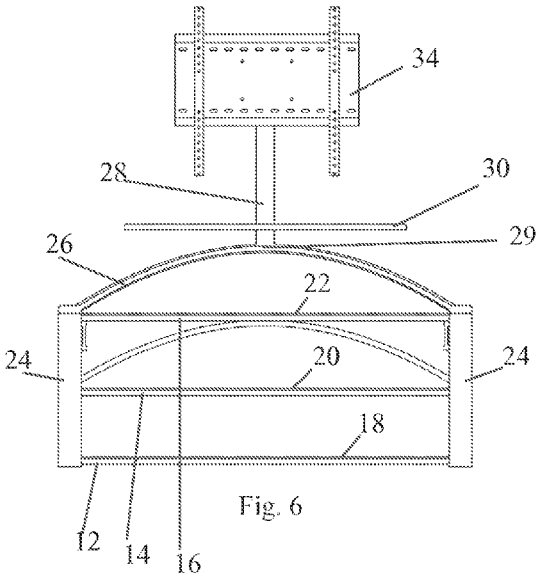
FIG. 6 is a front view thereof.
Figure 7:
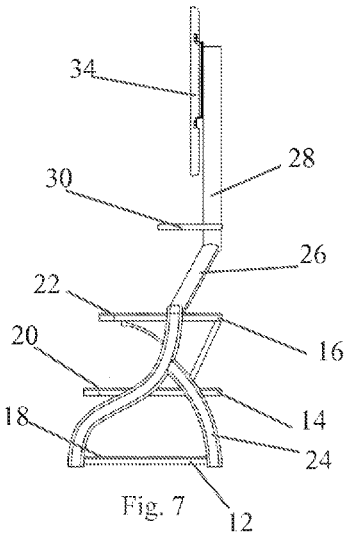
FIG. 7 is a right view thereof.

The assembly instructions 15 also direct a consumer to assemble the kit in a second possible configuration, as shown in FIG. 2, in which the flat panel TV 11 is secured to the mounting frame 34, which is secured to a wall in the room. This configuration does not use the vertical column 28, and the bridging structure 26 is not inserted into the bridge receptacles. Instead, to cover the openings in the legs 24 defined by the bridge receptacles 25, the consumer inserts caps 35 into the bridge receptacles 25. These caps 35 provide a solid upper end on each leg 24. The console 10 is positioned beneath the mounting frame 34 so that the TV 11 is secured above the console 10. The console 10 can be used to support accessory components for the TV 11.

Figure 3:
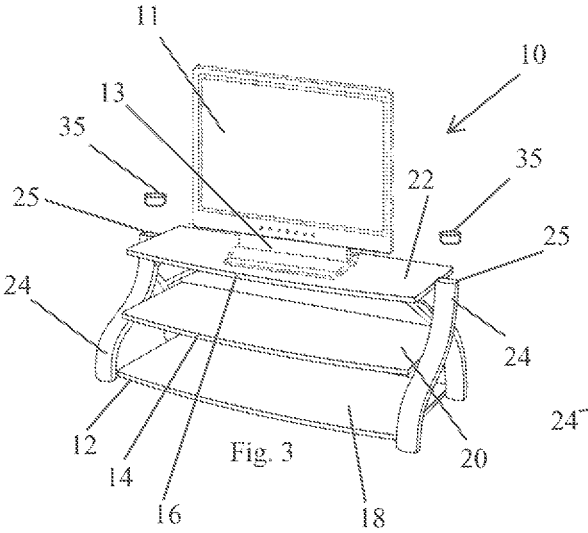
FIG. 3 is a perspective view thereof in a third configuration.

The assembly instructions 15 still further direct a consumer to assemble the components in a third possible configuration, as shown in FIG. 3, in which the TV 11 is supported directly on the upper surface of the upper shelf 22 of the console 10. In this configuration, the mounting frame 34, vertical column 28, and bridging structure 26 are omitted. As in the second configuration, the caps 35 are inserted in the bridge receptacles 25. The television 11 is supported by a TV stand, such as one typically purchased with a flat panel TV 11, and which is not necessarily a part of the kit of the present invention.

Figure 8:
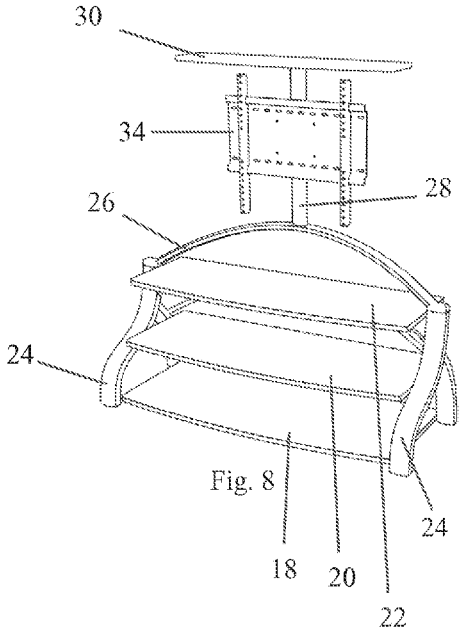
FIG. 8 is a perspective view thereof with the sound bar/sensor shelf positioned above the mounting frame.

FIGS. 4-7 show the console assembly 10 in the configuration of FIG. 1A without the TV 11 mounted on the mounting frame 34. FIG. 8 shows the console assembly in the configuration of FIG. 1B without the TV 11 mounted on the mounting frame 34. FIGS. 4-8 further illustrate the aesthetically matched design of the kit components.

When the ends of the bridging structure 26 are received in the bridge receptacles 25, the bridging structure 26 spans the width of the console 10 and can be used to support a TV 11 above the console 10 by way of a vertical column 28. The vertical column 28 has a lower end that can be detachably secured to the bridging structure 26 at a joint so that the vertical column 28 extends upwardly from the bridging structure 26 and the vertical column 28 provides an elevated support for a flat panel television 11. The joint can be fixed or it can allow rotation of the vertical column with respect to the bridging structure so that the TV 11 can be rotated to the left or right with respect to the console 10 as desired.

Figure 9:
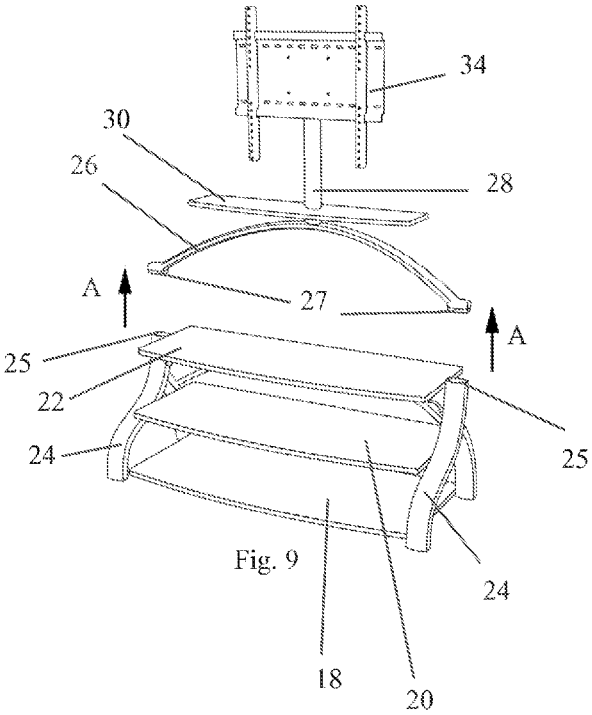
FIG. 9 shows how the bridging structure may be removed from the legs.
Figure 10:
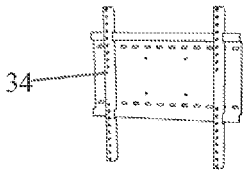
FIG. 10 shows the kit in a second configuration.
Figure 10:
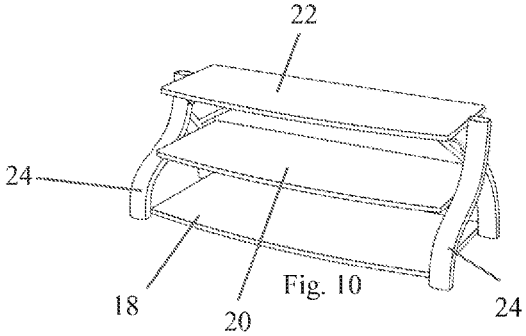
Figure 12:
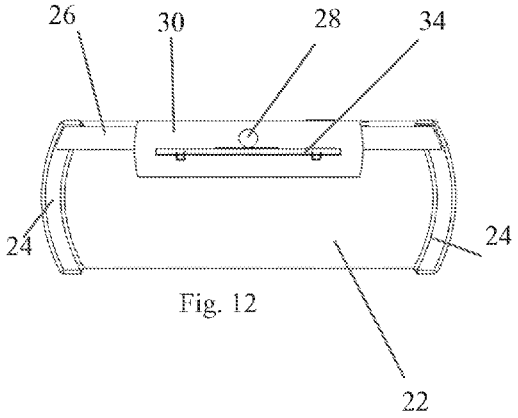
FIG. 12 is a top view thereof.
Figure 11:
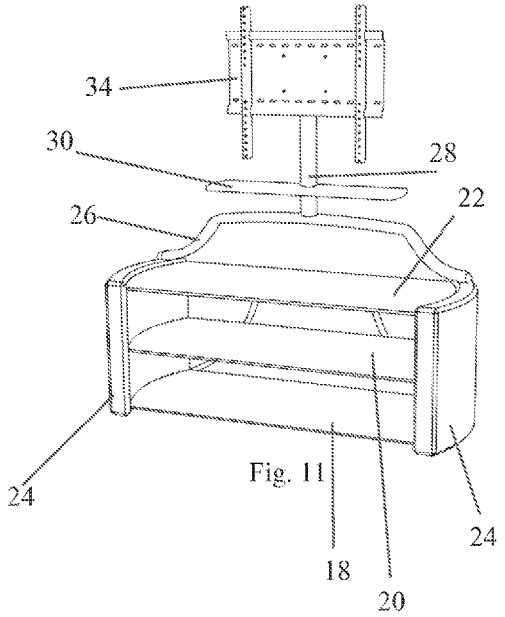
FIG. 11 is a perspective view of a second embodiment of the kit in a first configuration.

FIGS. 9-10 show how the console 10 may be converted from the configuration of FIG. 1A to the configuration of FIG. 2. FIG. 9 shows that the upper ends of the legs 24 have bridge receptacles 25 that can each receive an end of the bridging structure 26. The bridge receptacles 25 visible in FIG. 9 are upwardly facing openings on the upper ends of the legs 24 of the console 10. The bridging structure has two ends, each with a downwardly facing projection 27. To secure the bridging structure 26 to the legs 24, the consumer inserts the projections 27 into the openings defined by the upwardly facing bridge receptacles 25. The consumer may then use fasteners to further secure the ends of the bridging structure to the legs of the console assembly. To convert the console 10 from the first configuration to the second configuration, the consumer may simply unfasten the bridging structure 26 from the legs 24 and move the bridging structure 26 in the direction of the arrows A. The consumer then inserts a cap 35 into each bridge receptacle 25, as shown in FIG. 2, to form a solid upper surface on each leg 24.

Figure 13:
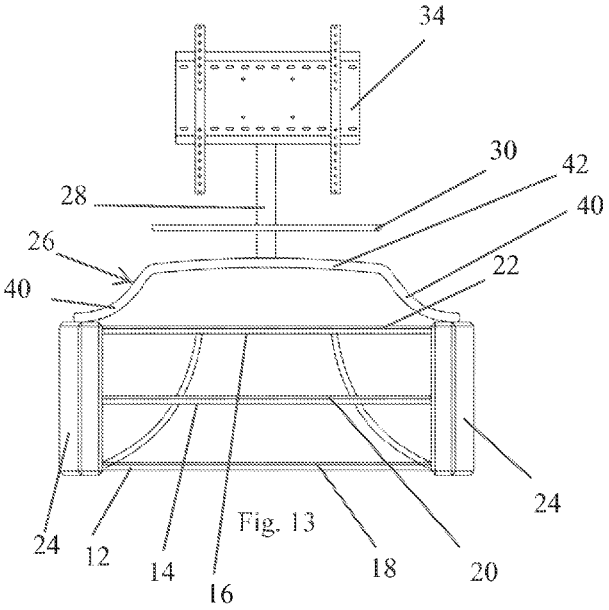
FIG. 13 is a front view thereof.
Figure 14:
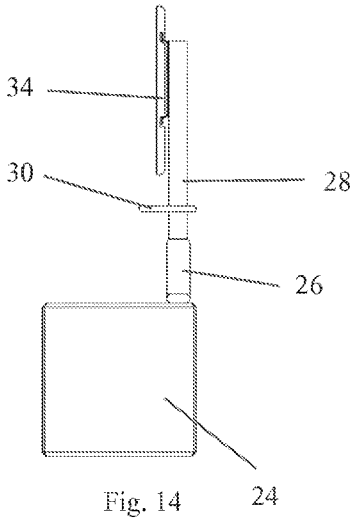
FIG. 14 is a right view thereof.
Figure 15:
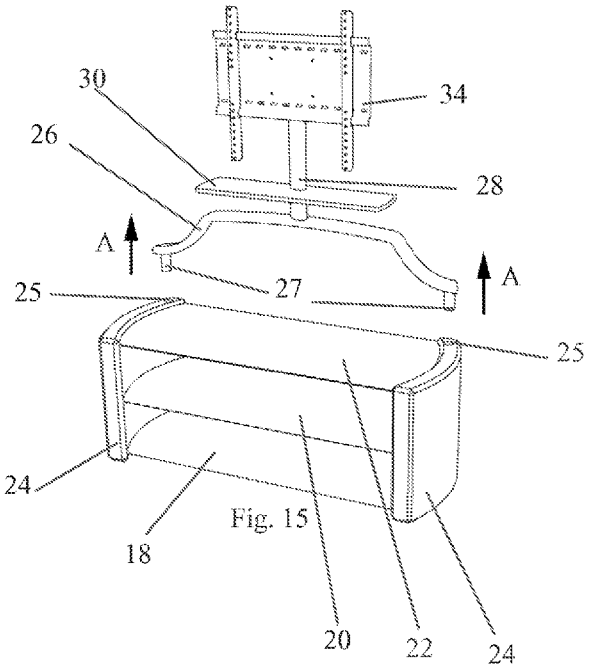
FIG. 15 shows how the bridging structure may be removed from the legs.
Figure 16:
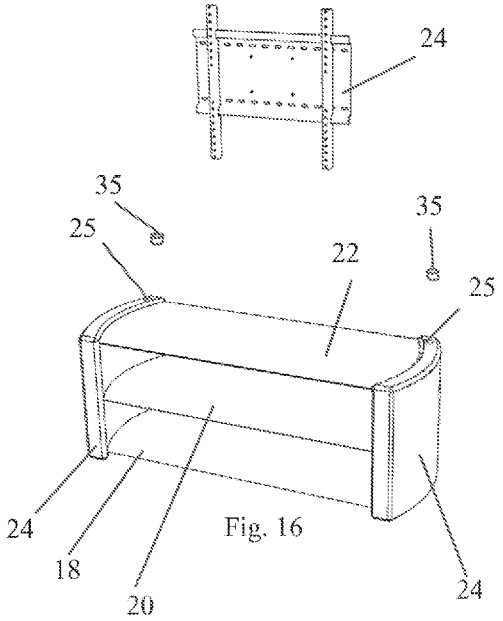
FIG. 16 shows the kit in a second configuration.

The bridging structure 26 can be in the form of an arch between the first and second ends, as shown in FIGS. 1A-10, or it can be linear between the first and second ends. FIGS. 11-16 show a second embodiment of the present invention, in which the bridging structure is not in the form of a continuous arch between its ends. The front view of the bridging structure 26 in FIG. 13 shows upwardly concave sections 40 at the ends of the bridging structure and a downwardly concave middle section 42 of the bridging structure 26.

It can therefore be seen that the present invention provides a console assembly, a bridging structure, a vertical column, a cap structure and a mounting frame that can be constructed and arranged with an aesthetically matched design to form an aesthetically matched set of kit components. Additionally, the present invention provides advantages to the consumer and the retailer. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A flat panel television console and support kit for use in a plurality of different user assembled configurations comprising:

a bridging structure having a first end and a second end;

a vertical column having a lower end detachably secured to said bridging structure at a joint on said bridging structure so that said vertical column extends upwardly from said bridging structure, said vertical column providing an elevated support for a flat panel television;

a flat panel television console assembly including a first leg and a second leg, upper and lower horizontally extending shelf supports supported between said first and second legs, and upper and lower shelves respectively carried on said upper and lower shelf supports, said flat panel television console assembly being capable of supporting a flat panel television on an upper surface of said upper shelf, said first and second legs each including a bridge receptacle at an upper end thereof;

a flat panel television mounting frame;

said kit including assembly instructions directing a user to assemble said kit in a plurality of different user assembled configurations, said assembly instructions directing a user to assemble said kit in a first configuration wherein a flat panel television is secured to said mounting frame, said mounting frame is secured adjacent to an upper end of said vertical column, and said first and second ends of said bridging structure are detachably secured in assembled relation with said bridge receptacles in first and second legs of said console assembly whereby said bridging structure is supported above said upper surface of said upper shelf and said vertical column supports said flat panel television above said console;

said assembly instructions directing a user to assemble said kit in a second configuration wherein said flat panel television is secured to said mounting frame and said mounting frame is secured to a wall and said console assembly is positioned beneath said wall mounted flat panel television to support accessory components of said flat panel television; and said assembly instructions directing a user to assemble said kit in a third configuration in which a flat panel television is supported on said upper shelf of said console.

2. The kit of claim 1 further comprising a first cap structure and a second cap structure, said first and second cap structures selectively received in assembled relation with said bridge receptacles;

wherein said assembly instructions direct a user to assemble said kit in a second configuration wherein said first and second cap structures are received in assembled relation with said bridge receptacles in said first and second legs; and further wherein said assembly instructions direct a user to assemble said kit in a third configuration in which said first and second cap structures are received in assembled relation with said bridge receptacles in said first and second legs.

3. The kit of claim 2 wherein said bridge receptacles comprise first and second upwardly facing openings, and said first and second ends of said bridging structure include respective projections which are received in interfitting mating relation with said first and second openings in said first and second legs.

4. The kit of claim 2 further comprising fasteners which secure said first and second ends of said bridging structure to said first and second legs of said console assembly.

5. The kit of claim 2 further comprising a sound bar/sensor shelf detachably secured to said vertical column and extending horizontally from said vertical column, said sound bar/sensor shelf being securable to said vertical column at a plurality of vertical positions.

6. The kit of claim 3 further comprising a sound bar/sensor shelf detachably secured to said vertical column and extending horizontally from said vertical column, said sound bar/sensor shelf being securable to said vertical column at a plurality of vertical positions.

7. The kit of claim 4 further comprising a sound bar/sensor shelf detachably secured to said vertical column and extending horizontally from said vertical column, said sound bar/sensor shelf being securable to said vertical column at a plurality of vertical positions.

8. The kit of claim 2 wherein said joint allows said vertical column to rotate with respect to said bridging section.

9. The kit of claim 3 wherein said joint allows said vertical column to rotate with respect to said bridging section.

10. The kit of claim 6 wherein said joint allows said vertical column to rotate with respect to said bridging section.

11. The kit of claim 2 wherein said joint is fixed to prevent rotation of said vertical column with respect to said bridging section.

12. The kit of claim 3 wherein said joint is fixed to prevent rotation of said vertical column with respect to said bridging section.

13. The kit of claim 6 wherein said joint is fixed to prevent rotation of said vertical column with respect to said bridging section.

14. The kit of claim 2 wherein said bridging structure forms an arch between said first end and said second end.

15. The kit of claim 2 wherein said bridging structure is linear between said first end and said second end.

16. The kit of claim 2 wherein said vertical column is hollow and has at least one opening for receiving wires.

* * * * *